US008955295B2

(12) United States Patent
Maetaka et al.

(10) Patent No.: US 8,955,295 B2
(45) Date of Patent: Feb. 17, 2015

(54) COIN WRAPPING MACHINE

(75) Inventors: Takeshi Maetaka, Hyogo (JP); Yusuke Inuki, Hyogo (JP); Kazuma Sugahara, Hyogo (JP); Yoshikatsu Ota, Hyogo (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 1029 days.

(21) Appl. No.: 12/737,889

(22) PCT Filed: Sep. 4, 2008

(86) PCT No.: PCT/JP2008/065949

§ 371 (c)(1),
(2), (4) Date: Feb. 25, 2011

(87) PCT Pub. No.: WO2010/026635

PCT Pub. Date: Mar. 11, 2010

(65) Prior Publication Data

US 2011/0154786 A1 Jun. 30, 2011

(51) Int. Cl.

| | |
|---|---|
| ***B65B 35/52*** | (2006.01) |
| ***B65B 11/56*** | (2006.01) |
| ***G07D 9/06*** | (2006.01) |

(52) U.S. Cl.

CPC ..... *B65B 11/56* (2013.01); *G07D 9/065* (2013.01)

USPC ..... 53/532; 53/531; 53/212

(58) Field of Classification Search

CPC ..... G07D 9/06; G07D 9/065; B65G 57/02; B65G 57/08; B65G 57/11

USPC ..... 53/532, 531, 212; 453/61, 62; 534/254

See application file for complete search history.

(56) References Cited

U.S. PATENT DOCUMENTS

| | | | | |
|---|---|---|---|---|
| 2,523,089 | A * | 9/1950 | Block | 53/254 |
| 3,265,077 | A * | 8/1966 | Kirkpatrick | 453/60 |
| 3,650,086 | A * | 3/1972 | Puhahn et al. | 53/501 |
| 3,743,118 | A * | 7/1973 | Fluck | 414/791 |

(Continued)

FOREIGN PATENT DOCUMENTS

| | | |
|---|---|---|
| JP | 2-90211 | 7/1990 |
| JP | 6-329121 | 11/1994 |

(Continued)

OTHER PUBLICATIONS

Japanese Office Action (JP Patent Application No. 2010-527620) (3 pages).

(Continued)

*Primary Examiner* — Gloria R Weeks

(74) *Attorney, Agent, or Firm* — Renner, Kenner, Greive, Bobak, Taylor & Weber

(57) ABSTRACT

The stacking unit is provided with a stacking space, which accepts coins transported by the transport unit from above and stacks the coins. In the stacking space, stack support portions which support coins to be stacked are provided movably up and down. Coins to be stacked are supported in an inclined state by the stack support portions. At a height in which the stack of coins supported by the stack support portions are stacked, an inclination maintaining portion in which the higher side of the inclination of a coin comes into contact with is provided. The inclinations of coins higher than a space portion are forcibly maintained by the inclination maintaining portion, the space portion being formed on the higher side of the inclination of the coin at a height in the stack of the coins.

4 Claims, 7 Drawing Sheets

(56) References Cited

U.S. PATENT DOCUMENTS

| | | | | | |
|---|---|---|---|---|---|
| 3,882,659 | A * | 5/1975 | Charlop | 53/254 |
| 3,967,435 | A * | 7/1976 | Bergmaier | 53/254 |
| 4,058,955 | A * | 11/1977 | Nakai et al. | 53/212 |
| 4,089,151 | A * | 5/1978 | Bergman et al. | 53/493 |
| 4,353,195 | A * | 10/1982 | Nakamura | 53/54 |
| 4,515,172 | A * | 5/1985 | Nakamura et al. | 453/32 |
| 4,674,260 | A * | 6/1987 | Rasmussen et al. | 53/212 |
| 4,820,237 | A * | 4/1989 | Shinozaki et al. | 453/61 |
| 4,832,655 | A * | 5/1989 | Sakurai | 453/61 |
| 4,949,532 | A * | 8/1990 | Fujimagari et al. | 53/542 |
| 5,011,457 | A * | 4/1991 | Takatani et al. | 453/61 |
| 5,389,034 | A * | 2/1995 | Rumbach | 453/61 |
| 7,470,175 | B2 * | 12/2008 | Sugahara et al. | 453/61 |
| 2002/0112455 | A1 * | 8/2002 | Sugahara et al. | 53/540 |

FOREIGN PATENT DOCUMENTS

| | | | |
|---|---|---|---|
| JP | 07-002224 | 1/1995 | B65B 35/52 |
| JP | 2-90211 | 7/1999 | B65B 35/50 |
| JP | 11-175790 | 7/1999 | G07D 3/08 |

OTHER PUBLICATIONS

European Search Report (Application No. 08810004.5—PCT/JP2008/065949) (dated Jun. 25, 2012—5 pages).

* cited by examiner

COIN WRAPPING MACHINE

TECHNICAL FIELD

The present invention relates to a coin wrapping machine which stacks a predetermined number of coins and wraps the stacked coins.

BACKGROUND ART

Conventionally, in a coin wrapping machine, a predetermined number of coins are stacked before the coins are wrapped. At the time of stacking coins, a stacking unit accepts coins transported one by one by a transport unit from above, and stacks the coins accepted in the stacking unit in a state where the coins are inclined and leaned. By thus inclining and leaning the coins, the coins can be aligned without a stacking disorder, and as a result, coins are neatly wrapped (for example, refer to Patent Document 1).

Patent Document 1: Japanese Patent No. 2971698 (page 3, FIG. 1 to FIG. 3)

DISCLOSURE OF THE INVENTION

Problem to be Solved by the Invention

However, a phenomenon occurs in which the patterns of coins stacked together catch each other, and there is a slight space in the horizontal direction inside the stacking unit, so that even if the coins are inclined, coins are stacked while shifting in the horizontal direction and the stacked coins become increasingly horizontal toward the upper side as the number of the stacked coins increases.

If the coins on the upper portion side of the stacked coins become increasingly horizontal, the position of the rear end (the transportation entrance path side) of the stacked coins becomes higher, so that a coin to enter and the end face may come into contact with each other and cause a stacking failure. If the coins become increasingly horizontal, the force generated pressing the coin entering downward becomes weak, so that the coin easily bounces, and may cause a stacking failure. Therefore, the coin stack becomes disordered, and as a result, the stacked coins cannot be neatly wrapped.

The present invention has been made in view of these circumstances, and an object thereof is to provide a coin wrapping machine which can reliably lean coins accepted in a stacking unit from a transport unit and stack the coins without disorder, and can neatly wrap the stacked coins.

Means to Solve the Problems

A coin wrapping machine of the present invention includes: a transport unit which transports coins one by one; a stacking unit provided with a stacking space in which a predetermined number of coins transported by the transport unit are accepted from above and stacked; a stack support portion which is provided with an inclined stack support surface on the upper surface, and supports coins stacked in the stacking space in an inclined state by the stack support surface, and lowers each time a coin is stacked; an inclination maintaining portion which maintains inclinations of coins higher than a space portion, the space portion being formed on the higher side of the inclination of a coin in the stack of coins supported by the stack support portion and stacked in the stacking space; and a wrapping unit which wraps a predetermined number of coins stacked in the stacking unit.

With the coin wrapping machine of the present invention, the higher side of the inclination of a coin comes into contact with and is caught by the inclination maintaining portion at a height in the stack of coins supported by the stack support portion and stacked in the stacking space, and this catching of the coin is released by lowering of the lower side of the inclination of the coin according to lowering of the stack support portion.

The coin wrapping machine of the present invention includes, a stopper which is provided at a position opposed to the transport unit above the stacking space of the stacking unit and prevents coins transported by the transport unit from bouncing out, and the inclination maintaining portion is extended from the stopper to the stacking space, and narrows the width of the stacking space at a height in the stack of coins stacked in the stacking space.

With the coin wrapping machine of the present invention, the inclination maintaining portion is provided with a depression which the higher sides of inclinations of coins enter.

Effects of the Invention

With the coin wrapping machine of the present invention, the inclinations of the coins higher than the space portion are forcibly maintained by the inclination maintaining portion, the space portion being formed on the higher side of the inclination of a coin in the stack of coins, and coins accepted in the stacking unit from the transport unit can be reliably leaned and stacked without disorder, and the stacked coins can be neatly wrapped.

With the coin wrapping machine of the present invention, the higher side of the inclination of a coin comes into contact with and is caught by the inclination maintaining portion at a height in the stack of coins supported by the stack support portion and stacked in the stacking space, and this catching of the coin is released by lowering of the lower side of the inclination of the coin according to lowering of the stack support portion, so that coins can be stably stacked while the inclinations of coins higher than the space portion in the stack are reliably maintained.

With the coin wrapping machine of the present invention, the inclination maintaining portion is extended from the stopper that prevents coins transported by the transport unit from bouncing out, and narrows the width of the stacking space at a height in the stack of coins stacked in the stacking space, so that the number of components can be reduced, and the inclination maintaining portion holds a part of the stacked coins, and therefore, the weight burden on the inclination maintaining portion can be reduced.

With the coin wrapping machine of the present invention, a depression which the higher sides of the inclinations of coins enter is provided on the inclination maintaining portion, so that a coin with a smaller diameter more deeply enters the depression of the inclination maintaining portion and the distance between the coin and the stopper can be made shorter, and therefore, regardless of the diameters of coins, the distances between the stopper and the coins accepted in the stacking unit can be made substantially constant, and the coins can be stably stacked.

REFERENCE NUMERALS

Figure 1:
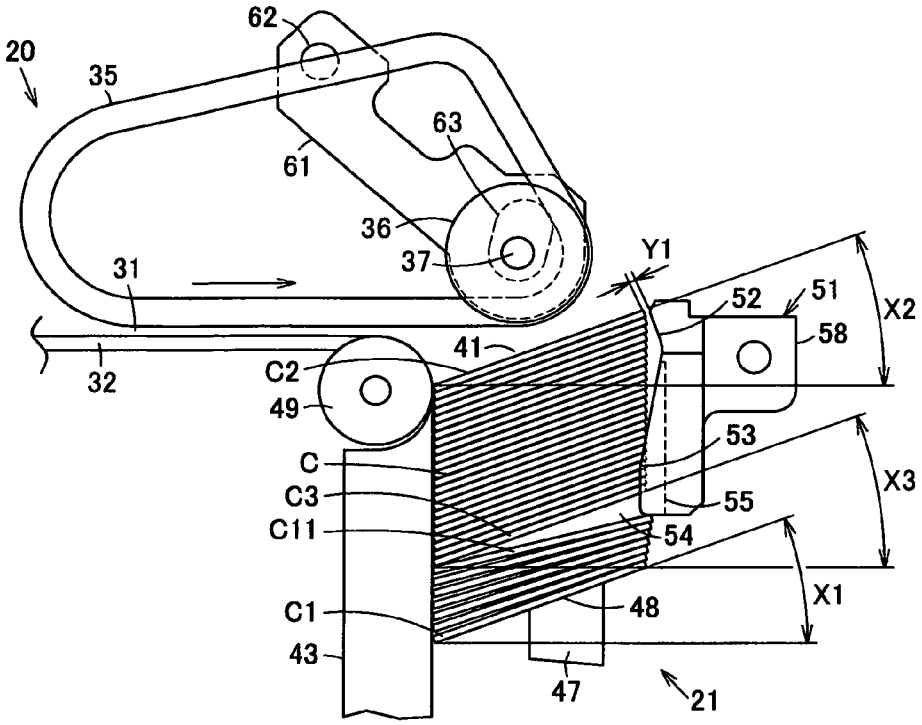
FIG. 1 is a side view of a transport unit and a stacking unit in which large diameter coins are stacked of a coin wrapping machine showing a first embodiment of the present invention.

20 Transport unit
21 Stacking unit
22 Wrapping unit
41 Stacking space
47 Stack support portion
48 Stack support surface
52 Stopper
53 Inclination maintaining portion
54 Space portion
55 Depression
C Coin

BEST MODE FOR CARRYING OUT THE INVENTION

Hereinafter, embodiments of the present invention will be described with reference to the drawings.

First, a first embodiment will be described with reference to FIG. 1 to FIG. 8.

Figure 8:
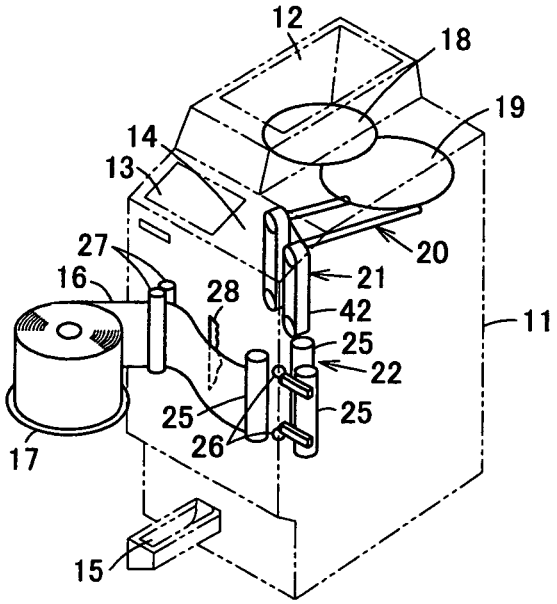
FIG. 8 is a perspective view of the same coin wrapping machine.

As shown in FIG. 8, on an upper portion of a machine body 11 of a coin wrapping machine, a hopper 12 into which coins to be processed are input, a display unit 13 which displays a selected denomination and various settings, etc., and an operation unit 14 for which operations for inputting denominations and various settings are performed are disposed. On the front portion of the machine body 11, a wrapped coin dispensing unit 15 which dispenses wrapped coins to the outside is disposed. On a side portion of the machine body 11, a wrapping paper supply base 17 which has a rolled wrapping paper 16 for wrapping coins disposed thereon and supplies the wrapping paper into the machine body 11 is disposed.

Inside the machine body 11, a supply disk 18 which supplies coins to the lower side of the hopper 12, a feed disk 19 which feeds coins supplied from the supply disk 18 one by one, a transport unit 20 which transports coins fed one by one from the feed disk 19, a stacking unit 21 in which a predetermined wrapping unit number of coins transported to the terminal end of the transport unit 20 are stacked, and a wrapping unit 22 which prepares wrapped coins by wrapping the predetermined wrapping unit number of the stacked coins in the wrapping paper 16 below the stacking unit 21, are disposed.

The wrapping unit 22 includes three wrapping rollers 25, and stacked coins stacked in the stacking unit 21 are arranged and held between the wrapping rollers 25, and while the stacked coins are rotated, a predetermined length of wrapping paper 16 is wrapped around the peripheral surface of the stacked coins, the upper and lower end portions of the wrapping paper 16 are crimped around the upper and lower end faces of the stacked coins by a pair of upper and lower crimping hooks 26 to prepare wrapped coins. The formed wrapped coins are ejected downward and dispensed to the wrapped coin dispensing unit 15.

For supplying a predetermined length of wrapping paper 16, paper feed rollers 27 which supply wrapping paper 16 and a cutter 28 for cutting a predetermined length of the wrapping paper 16 are provided.

Next, as shown in FIG. 1, FIG. 2, and FIG. 5 to FIG. 7, the transport unit 20 includes a transport path 31 which transports coins (shown by the reference symbol C in FIG. 1 and FIG. 2) in a line. This transport path 31 is formed between path side plates 33 and 34 disposed on both sides of a path bottom plate 32 movably in the path width direction on the path bottom plate 32. At an end portion on the downstream side in the transporting direction of the transport path 31, the upper portion of the stacking unit 21 is disposed. The positions of the path side plates 33 and 34 are adjusted so as to change the path width according to setting of a denomination of coins to be wrapped.

Above the transport path 31, a transporting belt 35 which transports coins in the transport path 31 to the stacking unit 21 on the downstream side in the transporting direction is disposed. In the drawings, only the transporting belt 35 on the downstream side in the transporting direction of the transport path 31 is shown, however, a transporting belt not shown is also disposed on the upstream side in the transporting direction. The transporting belt 35 is an endless belt having an outer peripheral surface formed flat, and is wound around a plurality of pulleys (only a pulley 36 on the downstream side in the transporting direction is shown) supported rotatably above the path bottom plate 32.

The pulley 36 on the downstream side in the transporting direction is disposed above the stacking unit 21. This pulley 36 is axially supported rotatably by an axis 37, and this axis 37 is attached to an end portion of a support plate 38, and this support plate 38 is supported swingably by the support axis 39, and this support axis 39 is attached to a frame side not shown. Therefore, the pulley 36 is supported so as to swing up and down around the support axis 39.

In the transport path 31, a recognition unit which recognizes coins to be transported, a stopper which stops coins following the predetermined wrapping unit number of coins to be stacked in the stacking unit 21, and a discharge port for discharging coins with diameters smaller than the denomination to be wrapped, etc., are provided although these are not shown.

Next, the stacking unit 21 has a stacking space 41 which accepts coins transported by the transport unit 20 from above and stacks the predetermined wrapping unit number of coins. In this stacking space 41, a pair of the stacking belts 42 are disposed on both sides of the stacking space 41 in a direction orthogonal to the transporting direction of coins from the transport unit 20, and on both sides of the stacking space 41 in the transporting direction of coins from the transport unit 20, a first guide 43 and a second guide 44 are disposed, respectively. The first guide 43 is disposed on the transport unit 20 side, and the second guide 44 is disposed on the side opposite to the transport unit 20. Therefore, between the pair of the stacking belts 42 and the first guide 43 and second guide 44, the stacking space 41 is formed.

The pair of the stacking belts 42 are tensioned between the upper and lower pulleys 46, and the belt surfaces are opposed to each other via a gap slightly larger than the diameter of coins to be wrapped. Stack support portions 47 are attached to the surfaces of the pair of the stacking belts 42. On the upper surfaces of the stack support portions 47, stack support surfaces 48 on which coins are placed and supported are formed. The stack support surfaces 48 are formed into inclined surfaces whose first guide 43 sides are lower and whose second guide 44 sides are higher so that the stack support surfaces 48 slope down at a predetermined inclination angle X1 toward the transport unit 20 side. On the stack support portions 47 of the pair of the stacking belts 42, the lowest coin to be stacked in the stacking space 41 is placed across the stack support portions 47, and a coin is stacked in an inclined state where the first guide 43 side becomes the lower side of the inclination of the coin and the second guide 44 side becomes the higher side of the inclination of the coin.

The opposed surfaces of the pair of the stacking belts 42 are rotated in conjunction with each other in the same direction by driving of a motor not shown. Then, each time coins transported by the transport unit 20 are accepted and stacked one by one in the stacking space 41, the stack support portions 47 of the pair of the stacking belts 42 are lowered by a distance equivalent to one coin by driving of the motor, and accordingly, a predetermined wrapping unit number of coins can be stacked in the stacking space 41.

The first guide 43 is formed of a plate or the like long in the up-down direction along the stacking space 41. On the upper end portion of the first guide 43, a guide roller 49 for guiding the coin fed from the transport unit 20 into the upper portion of the stacking space 41 is disposed rotatably.

The second guide 44 is formed long in the up-down direction along the stacking space 41. Above the second guide 44, a stopper body 51 is disposed. The upper portion of the stopper body 51 is disposed above the stacking space 41, and the lower portion of the stopper body 51 is disposed in the stacking space 41.

At the upper portion of the stopper body 51, a stopper 52 which is opposed to the terminal end of the transport unit 20 above the stacking space 41 of the stacking unit 21 and drops coins transported by the transport unit 20 into the stacking space 41 while preventing the coins from bouncing out is formed. This stopper 52 is inclined so that its upper portion side approaches the center side of the stacking space 41, and the lower portion side separates from the stacking space 41 to the radially outer side.

On the lower portion of the stopper body 51, an inclination maintaining portion 53 extended downward integrally from the stopper 52 is formed. Ata height in the stack of coins supported by the stack support portions 47 and stacked in the stacking space 41, the higher side of the inclination of the coin (C3) comes into contact with and is caught by the inclination maintaining portion 53, and the inclination of the caught coin (C3) is set to a predetermined inclination angle X3, and the inclination angle X2 of the coin (C2) at the top of the stack is maintained at an angle substantially equal to the inclination angle X3. Accordingly, when the inclination of the coin (C11) at the top of the coins supported on the stack support surfaces 48 of the stack support portions 47 becomes close to horizontal, between the higher side of the inclination of the coin (C11) supported on the stack support surfaces 48 of the stack support portions 47 and the higher side of the inclination of the coin (C3) the inclination of which is maintained by the inclination maintaining portion 53, a space portion 54 is formed. The space portion 54 in the stack of coins is formed between the coin (C3) caught by the inclination maintaining portion 53 and the coin (C11) released from the inclination maintaining portion. Therefore, the inclination maintaining portion 53 maintains the inclinations of coins (C3 to C2) higher than the space portion 54 in the stack of coins.

The higher side of the inclination of the coin is caught by the inclination maintaining portion 53, and this catching is released downward when the lower side of the inclination of the coin lowers according to lowering of the stack support portions 47.

The inclination maintaining portion 53 has a depression 55 which the higher sides of inclinations of coins enter on a surface opposed to the stacking space 41 of the inclination maintaining portion 53. On both side edges of this depression 55, inclination contact portions 56 which gradually project to the inside of the stacking space 41 from the upper side and narrow the width (diameter) of the stacking space 41 are formed so that the higher sides of the inclinations of coins come into contact with and are caught by the inclination contact portions, and inclination maintaining contact portions 57 which maintain the inclinations of coins at a predetermined inclination angle X3 are formed on the lower sides of the inclination contact portions 56 so that the higher sides of inclinations of the coins are caught by the inclination maintaining contact portions. The smaller the diameter of a coin is, the larger the portion to enter the depression 55, and the larger the diameter of a coin is, the smaller the portion to enter the depression 55.

On the back surface of the stopper body 51, an attaching portion 58 to be attached to an adjustment mechanism not shown supporting the stopper body 51 is formed.

The pair of the stacking belts 42, the first guide 43, the second guide 44, and the stopper body 51, etc., are supported adjustably by the adjustment mechanism not shown so as to move to positions corresponding to denominations to be wrapped. By this adjustment mechanism, the opposing distance between the pair of the stacking belts 42 is adjusted around a central axis of the stacking space 41, and the positions of the stacking belts 42, the first guide 43, the second guide 44, and the stopper body 51 are adjusted in a direction orthogonal to the opposing direction of the pair of the stacking belts 42.

Above both sides of the stopper body 51, a plurality of fixed stoppers 59 are disposed so that the tip ends are opposed between the pulleys 36 and transporting belt 35 and the stopper 52. By the fixed stoppers 59, coins transported by the transport unit 20 are prevented from bouncing out in cooperation with the stopper 52.

On the side portion of the pulley 36 of the transporting belt 35, a detection lever 61 for detecting a coin jam in the stacking unit 21 or correcting the upper surface position of the stacked coins in the stacking unit 21 is disposed. The base end of this detection lever 61 is supported swingably by a support axis 62 attached to a frame not shown at a position above the more upstream side in the transporting direction of the transport unit 20 than the position of the stacking unit 21. The tip end side of the detection lever 61 is disposed at a position on the side portion of the pulley 36 of the transporting belt 35 above the stacking unit 21. Therefore, the detection lever 61 is disposed aslant from the base end to the tip end side along the transporting direction of the transport unit 20. On the tip end side of the detection lever 61, a hole portion 63 for avoiding interference with the axis 37 of the pulley 36 is formed. Therefore, the pulley 36 and the detection lever 61 are swingable independent of each other.

Figure 4:
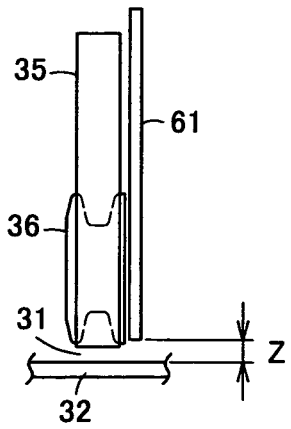
FIG. 4 is a front view showing a relationship between the transport unit and a detection lever of the same coin wrapping machine.
Figure 5:
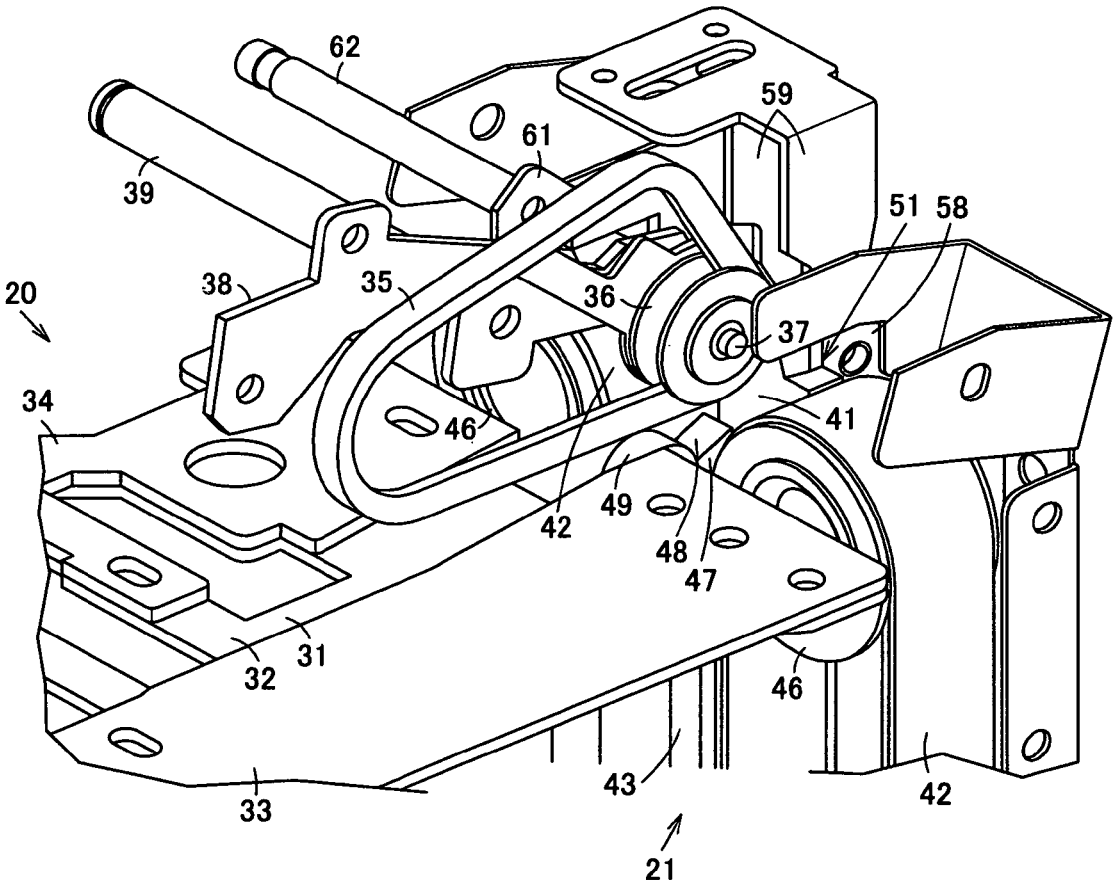
FIG. 5 is a perspective view of the transport unit and the stacking unit of the same coin wrapping machine from a lateral side.
Figure 6:
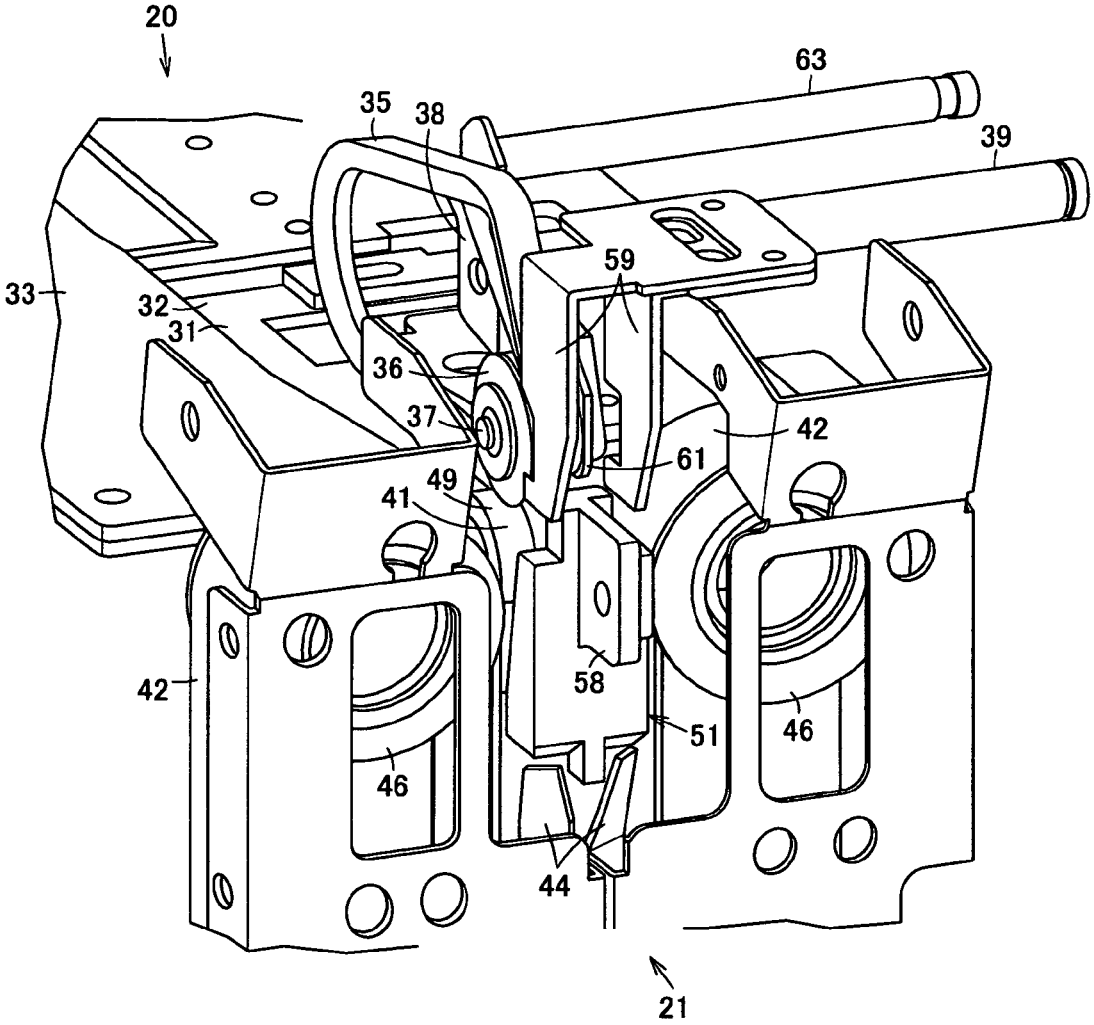
FIG. 6 is a perspective view of the transport unit and the stacking unit of the same coin wrapping machine from a front side.
Figure 7:
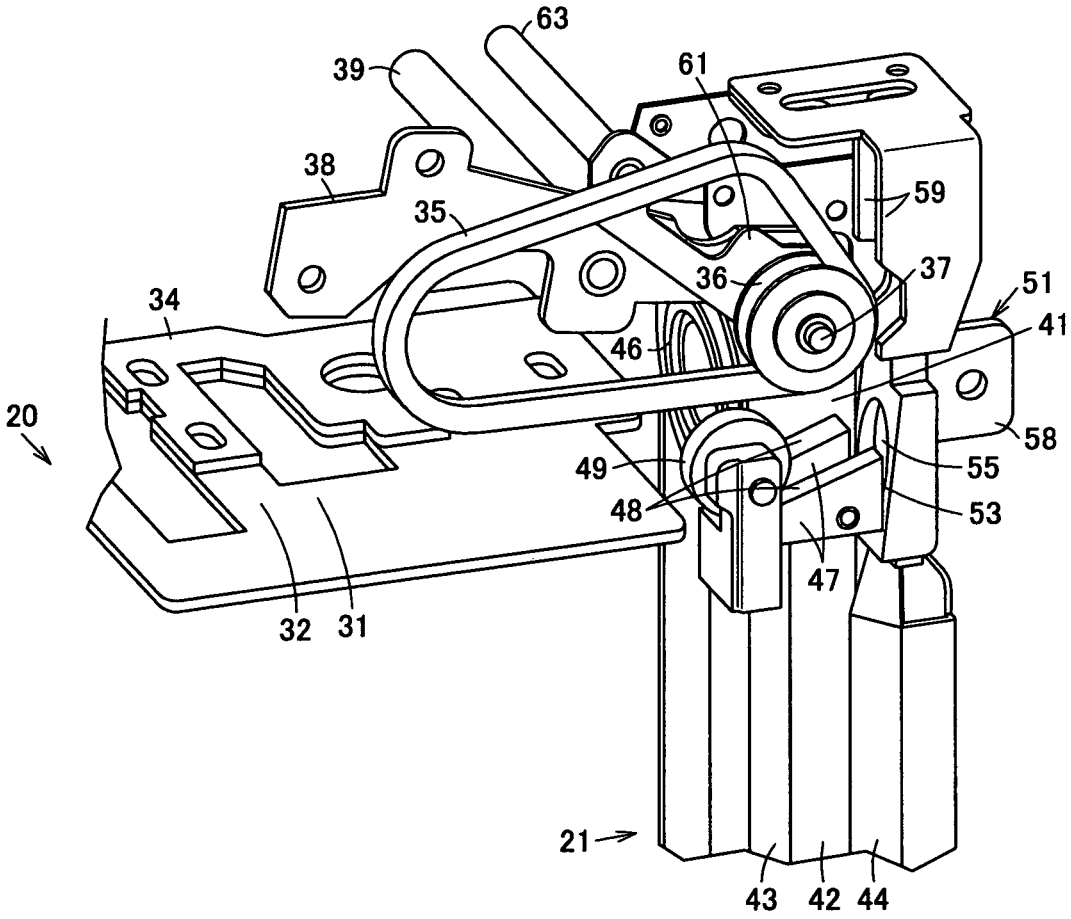
FIG. 7 is a perspective view of the transport unit and the stacking unit of the same coin wrapping machine from a lateral side in a partially omitted state.

As shown in FIG. 4, the lowered position of the tip end of the detection lever 61 is restricted at a position higher than the peripheral surfaces of the pulley 36 and the transporting belt 35 at a predetermined distance Z from the upper surface of the path bottom plate 32 of the transport path 31. This distance Z is set so that a coin to be normally accepted in the stacking unit 21 from the transport unit 20 or a coin slightly bouncing is prevented from coming into contact with or pushing the detection lever 61 up, and the detection lever 61 is pushed up by a coin jamming in the stacking unit 21 or a coin accepted in the stacking unit 21 from the transport unit 20 after the space above the coin at the top in the stacking unit 21 becomes small. The position of the detection lever 61 at which the detection lever is restricted from lowering is defined as a home position, and the detection lever 61 can swing up around the support axis 62 from the home position, and is biased toward the home position by a biasing unit such as a spring not shown.

A detection unit such as a switch or a sensor not shown which detects swinging up of the detection lever 61 from the home position is provided.

Next, operations of the coin wrapping machine will be described.

By setting a denomination to be wrapped by the operation unit 14 of the coin wrapping machine, the transport unit 20, the stacking unit 21, and the wrapping unit 22 are automatically adjusted according to the set denomination. Specifically, in the transport unit 20, the path width between the path side plates 33 and 34 is adjusted. In the stacking unit 21, the opposing distance between the pair of the stacking belts 42 is adjusted, and the positions of the stacking belts 42, the first guide 43, the second guide 44, and the stopper body 51 in the direction orthogonal to the opposing direction of the pair of the stacking belts 42 are adjusted. In the wrapping unit 22, the distance between the wrapping rollers 25 and the positions of the crimping hooks 26, etc., are adjusted.

Coins input into the hopper 12 of the coin wrapping machine are fed to the feed disk 19 from the supply disk 18, and coins are fed one by one to the transport unit 20 from the feed disk 19.

In the transport unit 20, coins fed out from the feed disk 19 are accepted between path side plates 33 and 34 on the both sides on the path bottom plate 32 of the transport path 31, and transported to the downstream side in the transporting direction by the transporting belt disposed on the upstream side in the transporting direction and the transporting belt 35 disposed on the downstream side in the transporting direction. During transportation, coins are recognized and counted by the recognition unit.

Coins transported to the terminal end of the transport unit 20 are ejected to the portion above the stacking unit 21. The coins ejected to the portion above the stacking unit 21 from the transport unit 20 come into contact with the stopper 52 due to a force from above of the transport unit 20 while, in the case of the first coin, sliding on the stack support surfaces 48 of the stack support portions 47, and in the case of the second and subsequent coins, while sliding on the upper surface of the stacked coins, and the coins drop into the stacking space 41 of the stacking unit 21 without bouncing out from the stacking unit 21, and are placed on the stack support surfaces 48 of the stack support portions 47 disposed in advance near the height of the transport path 31 of the transport unit 20. The coins placed on the stack support surfaces 48 are inclined down toward the transport unit 20 due to the inclinations of the stack support surfaces 48, and leaned to the guide roller 49 or the first guide 43.

Each time a coin is stacked in the stacking unit 21, the pair of the stacking belts 42 rotate and lower the stack support portions 47 by a distance equivalent to one coin, and creates a space for stacking the next coin on the coin at the top of the stack on the stack support portions 47.

Thereafter, coins successively transported from the transport unit 20 are successively stacked on the stacked coins on the stack support portions 47.

Then, the transporting belt 35 is extended to the portion above the stacking unit 21 by the pulley 36, the stack support surfaces 48 of the stack support portions 47 or the upper surface of the stacked coins is set near the height of the transport path 31, the stack support surfaces 48 or the upper surface of the stacked coins is inclined down toward the transport unit 20, and the detection lever 61 is positioned higher than the peripheral surface of the transporting belt 35 and does not come into contact with normally stacked coins, and therefore, coins transported from the transport unit 20 to the stacking unit 21 can be smoothly stacked in the stacking space 41.

When coin stacking in the stacking unit 21 is continued, at a height in the stack of coins supported on the stack support portions 47 and stacked in the stacking space 41, the higher side of the inclination of the coin comes into contact with and is caught by the inclination maintaining portion 53. Even when the higher side of the inclination of the coin is caught by the inclination maintaining portion 53, the lower side of the inclination of the coin is lowered by lowering of the stack support portions 47 and accordingly, the catching is released and the coin lowers.

By catching the higher side of the inclination of the coin (C3) by the inclination maintaining portion 53, the inclination of the caught coin (C3) is set to a predetermined inclination angle X3, and the inclination angle X2 of the coin (C2) at the top of the stack on the caught coin (C3) is maintained at an angle substantially equal to the inclination angle X3.

On the side lower than the inclination maintaining portion 53, in coins (C1) supported by the stack support surfaces 48 of the stack support portions 47 and stacked, patterns of coins stacked on each other may catch each other, and due to a slight space in the horizontal direction inside the stacking unit 21, coins are stacked while shifting horizontally although they are inclined, and as the number of the stacked coins increases, the coin (C11) may become gradually horizontal.

In this case, between the higher side of the inclination of the coin (C11) that is supported by the stack support surfaces 48 of the stack support portions 47 and has become close to horizontal and the higher side of the inclination of the coin (C3) the inclination of which is maintained by the inclination maintaining portion 53, that is, between the coin (C11) which is released from the inclination maintaining portion 53 and the coin (C3) caught by the inclination maintaining portion 53, a space portion 54 is formed. In this state, the inclinations of the coins (C3 to C2) higher than the space portion 54 in the stack of coins are maintained by the inclination maintaining portion 53.

Thus, the inclinations of coins higher than the space portion 54, in particular, the inclination of the coin (C2) at the top of the stack can be forcibly maintained by the inclination maintaining portion 53, the space portion 54 being formed on the higher side of the inclination of the coin in the stack of coins, and by a force from above of the transport unit 20, a coin accepted into the stacking unit 21 from the transport unit 20 can be made to enter the stacking unit while coming into sliding contact with the inclined surface of the stacked coins, and the coin can be stacked without disorder by being forcibly pressed downward, and reliably leaned.

Further, the inclination maintaining portion 53 is extended integrally from the stopper 52 that prevents coins transported by the transport unit 20 from bouncing out, and is provided so as to narrow the width of the stacking space at a height in the stack of coins stacked in the stacking space 41, so that the number of components can be reduced, and the inclination maintaining portion 53 is required to hold only a part of the stacked coins, so that the weight burden on the inclination maintaining portion 53 can be reduced.

Further, as shown in FIG. 1, when the denomination to be wrapped is of a large diameter coin, in a state where coins caught by both side edges of the depression 55 of the inclination maintaining portion 53 are maintained at the predetermined inclination angle X3, the portions of the peripheral edges of the coins to enter the depression 55 of the inclination maintaining portion 53 are small, and the distance between the coin stacked at the top of the stacking space 41 and the stopper 52 becomes Y1.

Figure 2:
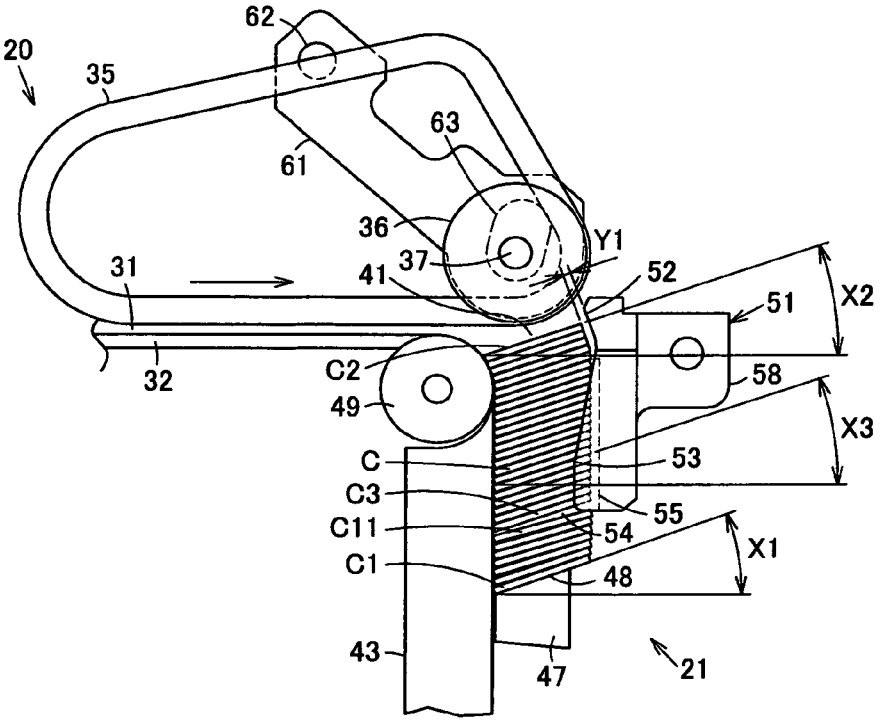
FIG. 2 is a side view of the transport unit and the stacking unit in which small diameter coins are stacked of the same coin wrapping machine.
Figure 3:
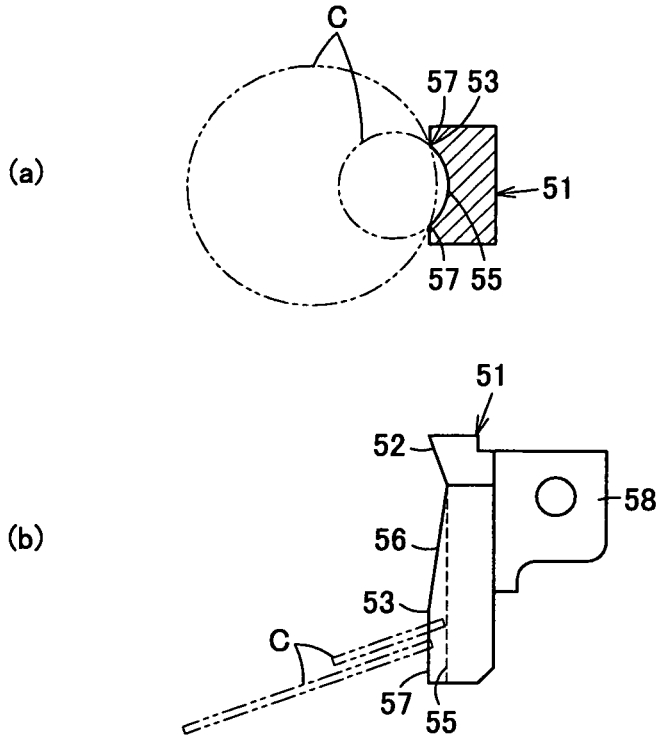
FIG. 3 show a relationship between an inclination maintaining portion of the stacking unit of the same coin wrapping machine and a large diameter coin and a small diameter coin, and FIG. 3(*a*) is a plan view, and FIG. 3(*b*) is a side view.

On the other hand, as shown in FIG. 2, when the denomination to be wrapped is of a small diameter coin, in a state where coins caught by both side edges of the depression 55 of the inclination maintaining portion 53 are maintained at the predetermined inclination angle X3, the portions of the peripheral edges of the coins to enter the depression 55 of the inclination maintaining portion 53 are large, and the distance Y1 between the coin stacked at the top of the stacking space 41 and the stopper 52 becomes substantially equal to that in the case of the large diameter coins.

Figure 9:
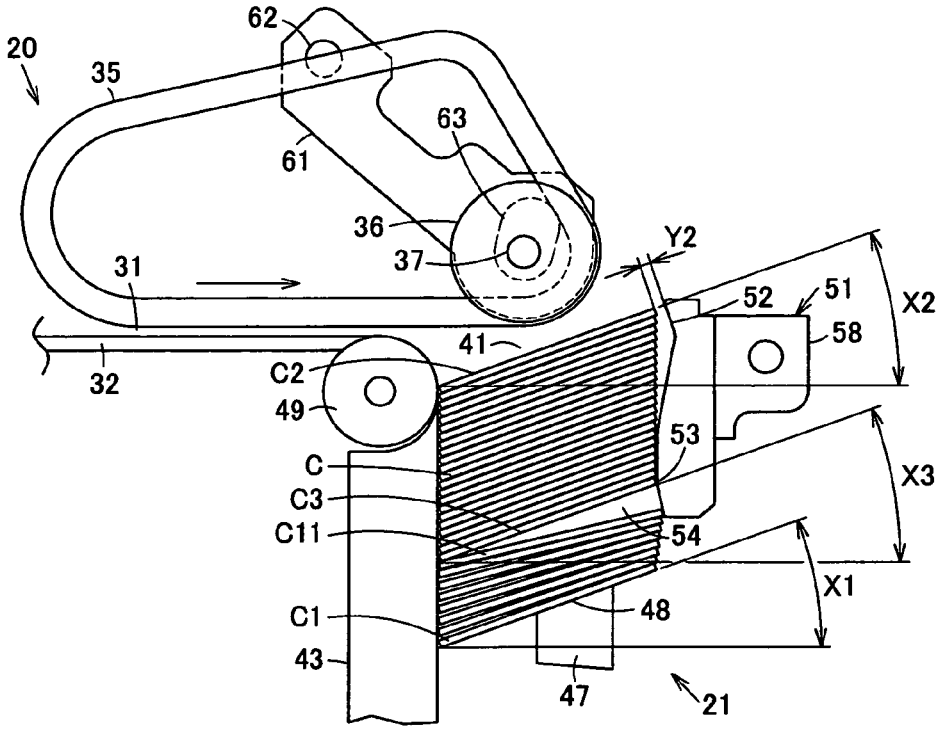
FIG. 9 is a side view of a transport unit and a stacking unit in which large diameter coins are stacked of a coin wrapping machine showing a second embodiment of the present invention.
Figure 10:
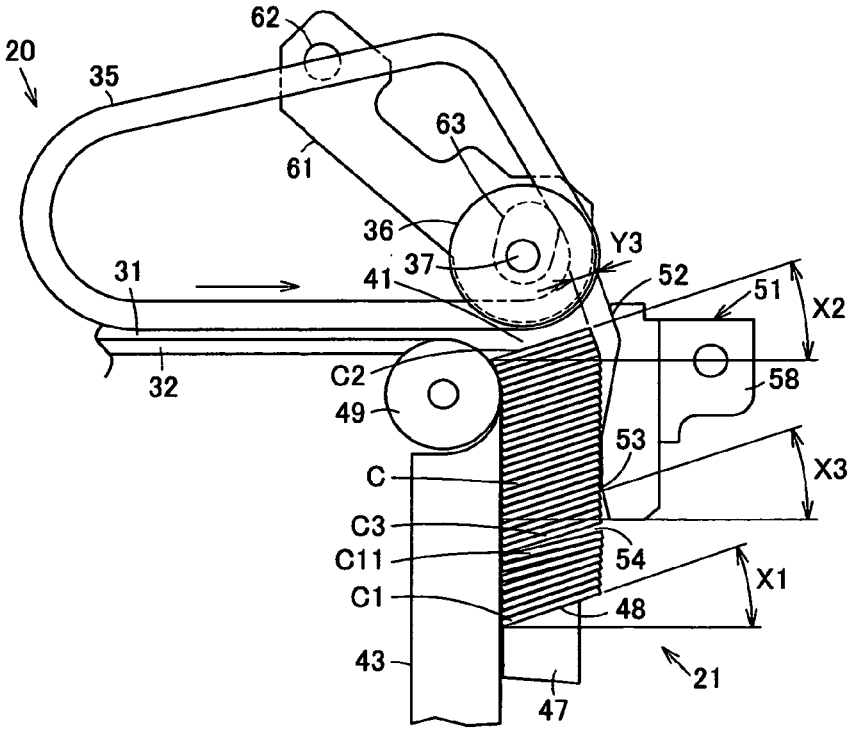
FIG. 10 is a side view showing the transport unit and the stacking unit in which small diameter coins are stacked of the same coin wrapping machine.

Here, an operation and effect of provision of the depression 55 on the inclination maintaining portion 53 will be described by comparison with the inclination maintaining portion 53 without the depression 55 as in the second embodiment shown in FIG. 9 and FIG. 10. As shown in FIG. 9, when the denomination to be wrapped is of a large diameter coin, in a state where coins caught by the inclination maintaining portion 53 are maintained at the predetermined inclination angle X3, the distance between the coin stacked at the top of the stacking space 41 and the stopper 52 becomes Y2. On the other hand, as shown in FIG. 10, when the denomination to be wrapped is of a small diameter coin, in a state where coins caught by the inclination maintaining portion 53 are maintained at the predetermined inclination angle X3, the distance Y3 between the coin stacked at the top of the stacking space 41 and the stopper 52 becomes larger than the distance Y2 in the case of the large diameter coins.

Therefore, by shaping the inclination maintaining portion 53 so as to have the depression 55 which the higher sides of inclinations of coins enter, the smaller diameter coins more deeply enter the inclination maintaining portion 53 and the distance between the coin stacked at the top of the stacking space 41 and the stopper 52 can be made shorter, and accordingly, regardless of the diameters of coins, the distance between the coin stacked at the top of the stacking space 41 and the stopper 52 can be made substantially constant, and coins can be stably stacked.

Then, when a predetermined wrapping unit number of coins are recognized and counted by the recognition unit of the transport unit 20, coins following the predetermined wrapping unit number of coins are stopped by the stopper, and the predetermined wrapping unit number of coins are stacked in the stacking unit 21.

After the wrapping unit number of coins are stacked in the stacking unit 21, the stopper body 51 is moved to the radially outer side to separate from the stacking space 41, and then, the stacked coins are lowered by lowering the stack support portions 47, and delivered to the wrapping unit 22 side.

Then, in the wrapping unit 22, the stacked coins are received from the stacking unit 21, arranged and held between the wrapping rollers 25, and a predetermined length of wrapping paper 16 is wrapped around the peripheral surface of the stacked coins while the stacked coins are rotated, and upper and lower end portions of the wrapping paper 16 are crimped around the upper and lower end faces of the stacked coins by the pair of upper and lower crimping hooks 26 to prepare wrapped coins.

In the case where the detection lever 61 is used for detecting coin jam in the stacking unit 21, when a coin jam occurs, the detection lever 61 is pushed up by coins jamming in the stacking unit 21. By detecting this pushing-up of the detection lever 61, driving is stopped, and the coin jam can be eliminated.

On the other hand, when the detection lever 61 is used for correcting the upper surface position of the stacked coins in the stacking unit 21, due to variation of the stack height of coins stacked in the stacking unit 21, the space above the coin at the top is reduced, and the detection lever 61 is pushed up by the coins accepted in the stacking unit 21 from the transport unit 20. By detecting this pushing-up of the detection lever 61, the stack support portions 47 are lowered by a predetermined distance to widen the space above the coin at the top, and this space can be properly maintained.

Conventionally, as described in Japanese Patent No. 2971698, a configuration is known in which the transporting belt of the transport unit which transports coins is extended to the portion above the stacking unit, and this transporting belt is supported movably up and down, and a detection unit which detects that the transporting belt is pushed up is provided. In this configuration, when coins stacked in the stacking unit bite into the stacking unit or a coin thicker than the coin of the denomination to be wrapped enters the stacking unit, by detecting that the transporting belt has been pushed up by the detection unit, a stacking failure is judged. However, in this configuration, the transporting component and the stacking failure detecting component are identical to each other, and the transporting belt may be pushed up by bouncing of a coin during stacking of coins, and this is erroneously detected as a stacking failure and driving is frequently-interrupted during the stacking process.

In the present embodiment, the transporting belt 35 of the transport unit 20 and the detection lever 61 are provided separately of each other, and further, the lowered position of the detection lever 61 is set to be higher than the upper surface of the transport path 31 of the transport unit 20, and accordingly, even if a coin slightly bounces, the bouncing is prevented from being directly transmitted to the detection lever 61, so that erroneous detection can be reduced.

Next, a second embodiment is shown in FIG. 9 and FIG. 10.

In the first embodiment, the depression 55 of the inclination maintaining portion 53 is provided, however, in this second embodiment, an example of the inclination maintaining portion 53 which is not provided with the depression 55 is shown.

Even with this inclination maintaining portion 53, when coin stacking in the stacking unit 21 is continued, at a height in the stack of coins supported by the stack support portions 47 and stacked in the stacking space 41, the higher side of the inclination of a coin comes into contact with and is caught by the inclination maintaining portion 53. Although the higher side of the inclination of the coin is caught by the inclination maintaining portion 53, the lower side of the inclination of the coin is lowered by lowering of the stack support portions 47, and accordingly, the catching is released and the coin lowers.

According to catching of the higher side of the inclination of the coin by the inclination maintaining portion 53, the inclination of the caught coin is set to a predetermined inclination angle X3, and the inclination angle X2 of the coin at the top of the stack on the caught coin can be maintained at an angle substantially equal to the inclination angle X3.

The coins stacked on the coin supported by the stack support surfaces 48 of the stack support portions 47 become increasingly horizontal, and accordingly, between the higher side of the inclination of the coin supported by the stack support surface 48 of the stack support portion 47 and the higher side of the inclination of the coin the inclination of which is maintained by the inclination maintaining portion 53, a space portion 54 is formed. In this state, the inclinations of coins higher than the space portion 54 in the stack of coins are maintained by the inclination maintaining portion 53.

As shown in FIG. 9, when the denomination to be wrapped is of a large diameter coin, the space portion 54 in the stack of the coins is formed between a coin caught by the inclination maintaining portion 53 and a coin released from the inclination maintaining portion.

On the other hand, as shown in FIG. 10, when the denomination to be wrapped is of a small diameter coin, the space portion 54 in the stack of coins is formed slightly lower than the coin caught by the inclination maintaining portion 53 because the inclinations of coins up to the coin slightly lower than the coin caught by the inclination maintaining portion 53 are maintained. However, even in this case of a small diameter coin, the space portion may be formed between the coin caught by the inclination maintaining portion 53 and the coin released therefrom as in the case of a large diameter coin.

Therefore, even with the inclination maintaining portion 53 thus configured, the inclinations of the coins higher than the space portion 54, in particular, the inclination of the coin at the top of the stack can be forcibly maintained, the space portion 54 being formed on the higher side of the inclination of the coin in the stack of coins supported by the stack support portions 47 and stacked in the stacking space 41, and coins accepted from the transport unit 20 into the stacking unit 21 can be reliably leaned, and reliably stacked without disorder.

The inclination maintaining portion may be, for example, a projection or a rotatable roller, etc., as long as it can temporarily hold a coin in the stack of coins as in the embodiments described above.

INDUSTRIAL APPLICABILITY

The present invention is used in a coin wrapping machine that has a function to count varied coins, and a function to store and dispense wrapped coins as well as a coin handling machine having only a function to wrap coins.

The invention claimed is:

1. A coin wrapping machine comprising:

a transport unit which transports coins one by one;

a stacking unit provided with a stacking space in which a predetermined number of coins transported by the transport unit are accepted from above and stacked;

a stack support portion which is provided with an inclined stack support surface on the upper surface, and supports coins stacked in the stacking space in an inclined state by the stack support surface, and lowers each time a coin is stacked;

an inclination maintaining portion which maintains inclinations of coins higher than a space portion, the space portion being formed on the higher side of the inclination of a coin in the stack of coins supported by the stack support portion and stacked in the stacking space; and a wrapping unit which wraps a predetermined number of coins stacked in the stacking unit;

wherein the inclination maintaining portion is provided with a depression in which the higher sides of inclination of the coins enter.

2. The coin wrapping machine according to claim 1, wherein the higher side of the inclination of a coin comes into contact with and is caught by the inclination maintaining portion at a height in the stack of coins supported by the stack support portion and stacked in the stacking space, and this catching of the coin is released by lowering of the lower side of the inclination of the coin according to lowering of the stack support portion.

3. A coin wrapping machine comprising:

a transport unit which transports coins one by one;

a stacking unit provided with a stacking space in which a predetermined number of coins transported by the transport unit are accepted from above and stacked;

a stack support portion which is provided with an inclined stack support surface on the upper surface, and supports coins stacked in the stacking space in an inclined state by the stack support surface, and lowers each time a coin is stacked;

an inclination maintaining portion which maintains inclinations of coins higher than a space portion so that the space portion is formed on the higher side of the inclination of a coin in the middle of the stack of coins supported by the stack support portion and stacked in the stacking space;

a wrapping unit which wraps a predetermined number of coins stacked in the stacking unit; and a stopper which is provided at a position opposed to the transport unit above the stacking space of the stacking unit and prevents coins transported by the transport unit from bouncing out;

wherein the inclination maintaining portion is extended from the stopper to the stacking space, and narrows the width of the stacking space at a height in the middle of the stack of coins stacked in the stacking space; and wherein the inclination maintaining portion is provided with a depression which the higher sides of inclinations of coins enter.

4. The coin wrapping machine according to claim 3, wherein the higher side of the inclination of a coin comes into contact with and is caught by the inclination maintaining portion at a height in the middle of the stack of coins supported by the stack support portion and stacked in the stacking space, and this catching of the coin is released by lowering of the lower side of the inclination of the coin according to the lowering of the stack support portion.

* * * * *